US010815838B1

(12) United States Patent
Son et al.

(10) Patent No.: US 10,815,838 B1
(45) Date of Patent: Oct. 27, 2020

(54) CONTINUOUSLY VARIABLE VALVE DURATION APPARATUS AND ENGINE PROVIDED WITH THE SAME

(71) Applicants: HYUNDAI MOTOR COMPANY, Seoul (KR); KIA MOTORS CORPORATION, Seoul (KR)

(72) Inventors: You Sang Son, Suwon-si (KR); In Sang Ryu, Yongin-si (KR); Kyoung Pyo Ha, Seongnam-si (KR); Dongheon Park, Seongnam-si (KR); Back Sik Kim, Osan-si (KR); Seung Jae Lee, Bucheon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/692,512

(22) Filed: Nov. 22, 2019

(30) Foreign Application Priority Data

Jul. 12, 2019 (KR) ..... 10-2019-0084343

(51) Int. Cl.
*F01L 1/053* (2006.01)
*F01L 13/00* (2006.01)
*F02D 13/02* (2006.01)

(52) U.S. Cl.
CPC ..... *F01L 1/0532* (2013.01); *F01L 13/0015* (2013.01); *F02D 13/0215* (2013.01)

(58) Field of Classification Search
CPC ..... F01L 1/053; F01L 1/46; F01L 13/0015; F02D 13/0215
USPC ..... 123/90.15, 90.17, 90.27
See application file for complete search history.

(56) References Cited

U.S. PATENT DOCUMENTS

2013/0126260 A1 5/2013 Kim
2018/0100453 A1* 4/2018 Ryu ..... F02D 13/0211

FOREIGN PATENT DOCUMENTS

CN 201428774 Y 3/2010
CN 207683593 U 8/2018
EP 2660434 A1 11/2013
(Continued)

OTHER PUBLICATIONS

European Search Report for EP Application No. 19212321.4, dated May 25, 2020.

*Primary Examiner* — Jorge L Leon, Jr.
(74) *Attorney, Agent, or Firm* — McDonnell Boehnen Hulbert & Berghoff LLP

(57) ABSTRACT

A continuously variable valve duration apparatus may include a camshaft, a cam unit including a cam, and the camshaft inserted into the cam, a guide shaft on which a guide screw thread is formed and disposed perpendicular to the camshaft, a guide bracket on which the guide shaft is mounted, an inner wheel configured to transmit rotation of the camshaft to the cam unit, a wheel housing into which the inner wheel is rotatably inserted and movable perpendicular to the camshaft, and the wheel housing disposed within the guide bracket, a worm wheel to which an inner screw thread configured to engage with the guide screw thread is formed therewithin, and to which an outer screw thread is formed thereon, and the worm wheel disposed within the wheel housing, a control shaft on which a control worm configured to engage with the outer screw thread is formed.

18 Claims, 24 Drawing Sheets

(56) References Cited

FOREIGN PATENT DOCUMENTS

| | | | |
|---|---|---|---|
| EP | 3486441 | A1 | 5/2019 |
| KR | 2015-0002056 | A | 1/2015 |

* cited by examiner

CONTINUOUSLY VARIABLE VALVE DURATION APPARATUS AND ENGINE PROVIDED WITH THE SAME

CROSS-REFERENCE TO RELATED APPLICATION

This application claims priority to and the benefit of Korean Patent Application No. 10-2019-0084343 filed in the Korean Intellectual Property Office on Jul. 12, 2019, the entire contents of which are incorporated herein by reference.

BACKGROUND

(a) Field

The present disclosure relates to a continuously variable valve duration apparatus and an engine provided with the same.

(b) Description of the Related Art

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

Optimal operation of the intake valves and the exhaust valves depends on a rotation speed of the engine. For example, an optimal lift or optimal opening/closing timing of the valves depends on the rotation speed of the engine. In order to achieve such optimal valve operation depending on the rotation speed of the engine, various researches, such as designing of a plurality of cams and a continuously variable valve lift (CVVL) that can change valve lift depending on engine speed, have been undertaken.

The disclosure of this section is to provide background information relating to the invention. Applicant does not admit that any information contained in this section constitutes prior art.

SUMMARY

Various aspects of the present invention are directly providing a continuously variable valve duration apparatus and an engine provided with the same which may vary opening duration of a valve based on operation conditions of an engine and reduce noise and vibration.

In one form of the present disclosure a continuously variable valve duration apparatus may include a camshaft, a cam unit on which a cam is formed, and the camshaft inserted into the cam, a guide shaft on which a guide screw thread is formed and disposed perpendicular to the camshaft, a guide bracket on which the guide shaft is mounted, an inner wheel configured to transmit rotation of the camshaft to the cam unit, a wheel housing into which the inner wheel is rotatably inserted and movable perpendicular to the camshaft, and the wheel housing disposed within the guide bracket, a worm wheel to which an inner screw thread configured to engage with the guide screw thread is formed therewithin, and to which an outer screw thread is formed thereon, and the worm wheel disposed within the wheel housing, a control shaft on which a control worm configured to engage with the outer screw thread is formed, and an wheel elastic portion providing elastic force to the worm wheel to bring the worm wheel into close contact with the guide shaft and the control shaft.

The wheel elastic portion may be a double torsion spring.

A spring seating portion to which the double torsion spring is mounted may be formed to the worm wheel.

The double torsion spring may include a spring body winding on the spring seating portion and first and second support portions for elastically supporting the spring body, and first and second spring insert portions into which the first and second support portions are inserted may be formed inside the guide bracket.

An insertion hole into which the guide shaft is inserted and a moving space within which the wheel housing is movable may be formed to the guide bracket.

The continuously variable valve duration apparatus may further include two guide walls protruded from the wheel housing, and a moving hole formed in each of the two guide walls and the guide shaft configured to insert into the moving holes.

The worm wheel may be disposed between the guide walls and configured to selectively push one of the two guide walls to move the wheel housing.

The continuously variable valve duration apparatus may further include a sliding shaft fixed to the guide bracket configured to guide movement of the wheel housing, and a sliding hole formed in the wheel housing, and the sliding shaft configured to insert to the wheel housing.

The continuously variable valve duration apparatus may further include a worm shaft cap fixed to the guide bracket configured to support the control shaft.

The continuously variable valve duration apparatus may further include a first sliding hole and a second sliding hole respectively formed to the inner wheel, a cam slot formed to the cam unit, a roller wheel connected to the camshaft and rotatably inserted into the first sliding hole, and a roller cam slidably inserted into the cam slot and rotatably inserted into the second sliding hole.

The roller cam may include a roller cam body slidably inserted into the cam slot, a cam head rotatably inserted into the second sliding hole, and a protrusion configured to inhibit the roller cam from being removed.

The roller wheel may include a wheel body slidably connected to the camshaft, and a wheel head rotatably inserted into the first sliding hole.

The continuously variable valve duration apparatus may further include a camshaft oil hole formed within the camshaft along a longitudinal direction thereof, a body oil hole formed to the wheel body of the roller wheel and configured to communicate with the camshaft oil hole, and an oil groove formed to the wheel head of the roller wheel and configured to communicate with the body oil hole.

The cam unit may include a first cam portion and a second cam portion which are disposed corresponding to a cylinder and an adjacent cylinder respectively, and the inner wheel may include a first inner wheel and a second inner wheel configured to transmit the rotation of the camshaft to the first cam portion and the second cam portion respectively.

The first inner wheel and the second inner wheel may be connected rotatable to each other.

The continuously variable valve duration apparatus may further include a bearing disposed within the wheel housing and configured to support the first inner wheel and the second inner wheel.

The continuously variable valve duration apparatus may further include two cams formed in the first cam portion and the second cam portion respectively, a cam connecting portion formed between the two cams, and a cam cap on which a cam supporting portion configured to support the cam connecting portion is formed.

An engine according to an embodiment of the present invention may be provided with the continuously variable valve duration apparatus.

As described above, a continuously variable valve duration apparatus according to an embodiment of the present invention may vary an opening duration of a valve depending on operation conditions of an engine, with a simple construction.

The continuously variable valve duration apparatus according to an embodiment of the present invention may be reduced in size and thus the entire height of a valve train may be reduced. Since the continuously variable valve duration apparatus may be applied to an existing engine without excessive modification, thus productivity may be enhanced and production cost may be reduced.

The continuously variable valve duration apparatus according to an embodiment of the present invention can reduce noise and vibration by applying a wheel elastic portion even if there is a production error in the parts.

<Description of symbols>

Figure 1:
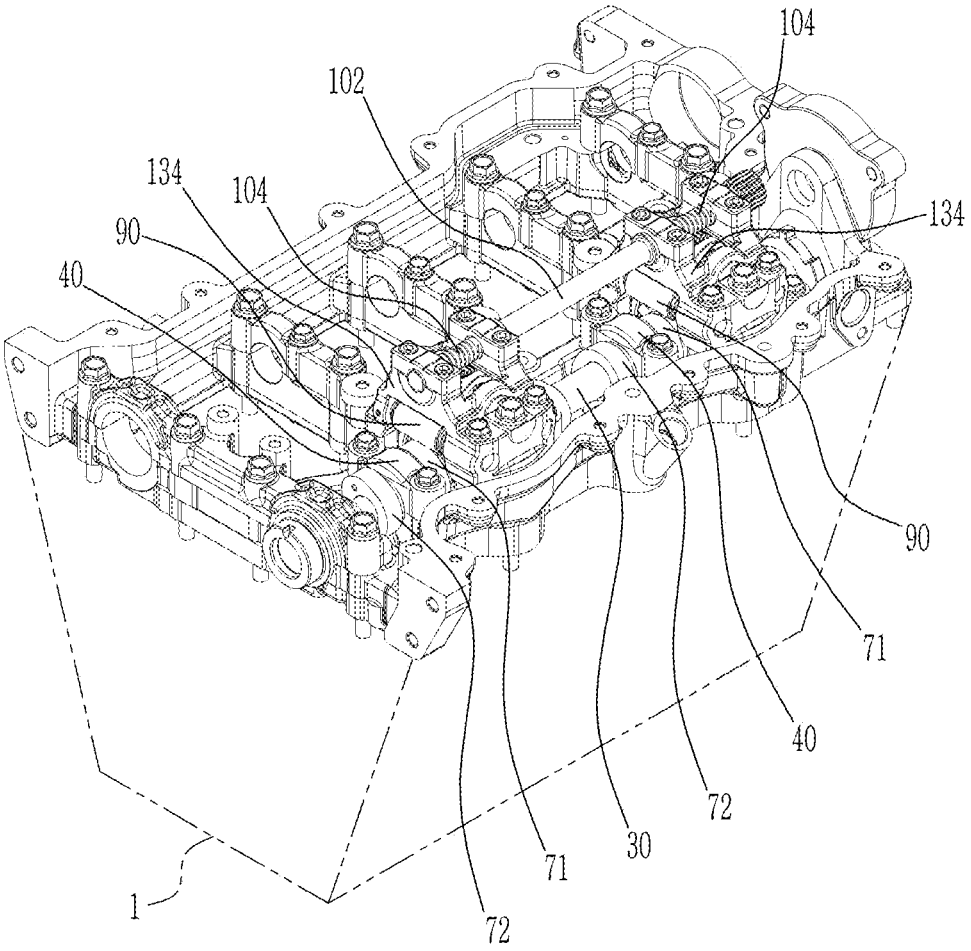
FIG. 1 is a perspective view of an engine provided with a continuously variable valve duration apparatus according to an embodiment of the present invention.

| | | | |
|---|---|---|---|
| 1: | engine | 30: | camshaft |
| 32: | camshaft oil hole | 34: | camshaft hole |
| 40: | cam cap | 50: | worm wheel |
| 52: | inner screw thread | 54: | outer screw thread |
| 56: | spring seating portion | 60: | roller wheel |
| 62: | wheel body | 64: | wheel head |
| 66: | body oil hole | 68: | oil groove |
| 69: | communicate hole | 70: | cam unit |
| 70a, 70b: | first/second cam portion | 71, 72: | cam |
| 74: | cam slot | 76: | cam connecting portion |
| 80: | inner wheel | 82: | roller cam |
| 82a: | roller cam body | 82b: | roller cam head |
| 82c: | protrusion | 83: | cam slot |
| 84: | first inner wheel connecting portion | | |
| 85: | second inner wheel connecting portion | | |
| 86: | first sliding hole | 88: | second sliding hole |
| 90: | wheel housing | 92: | guide wall |
| 94: | moving hole | 96: | sliding hole |
| 100: | controller | 102: | control shaft |
| 104: | control worm | 106: | control motor |
| 130: | guide screw thread | 132: | guide shaft |
| 132a: | connecting pin | 132b: | connecting hole |
| 134: | guide bracket | 134a: | first spring insert portion |
| 134b: | second spring insert portion | 135: | sliding shaft |
| 135a: | sliding shaft hole | 136: | bolt |
| 137: | insertion hole | 138: | moving space |
| 139: | worm shaft cap | 140: | bearing |
| 150: | wheel elastic portion | 152: | spring body |
| 154: | first support portion | 156: | second support portion |
| 200: | valve | 201-204: | first –4 cylinder |

DETAILED DESCRIPTION OF EMBODIMENTS

In the following detailed description, only certain embodiments of the present invention have been shown and described, simply by way of illustration.

As those skilled in the art would realize, the described embodiments may be modified in various different ways, all without departing from the spirit or scope of the present invention.

A part irrelevant to the description will be omitted to clearly describe the present invention, and the same or similar elements will be designated by the same reference numerals throughout the specification.

In the drawings, the thickness of layers, films, panels, regions, etc., are exaggerated for clarity.

Throughout the specification and the claims, unless explicitly described to the contrary, the word "comprise" and variations such as "comprises" or "comprising", will be understood to imply the inclusion of stated elements but not the exclusion of any other elements.

An embodiment of the present invention will hereinafter be described in detail with reference to the accompanying drawings.

In some implementations, in order to achieve such an optimal valve operation depending on the rotation speed of the engine, research is being conducted on a continuously variable valve timing (CVVT) apparatus that enables different valve timing operations depending on the engine speed. The CVVT may change valve timing with a fixed valve opening duration.

Figure 2:
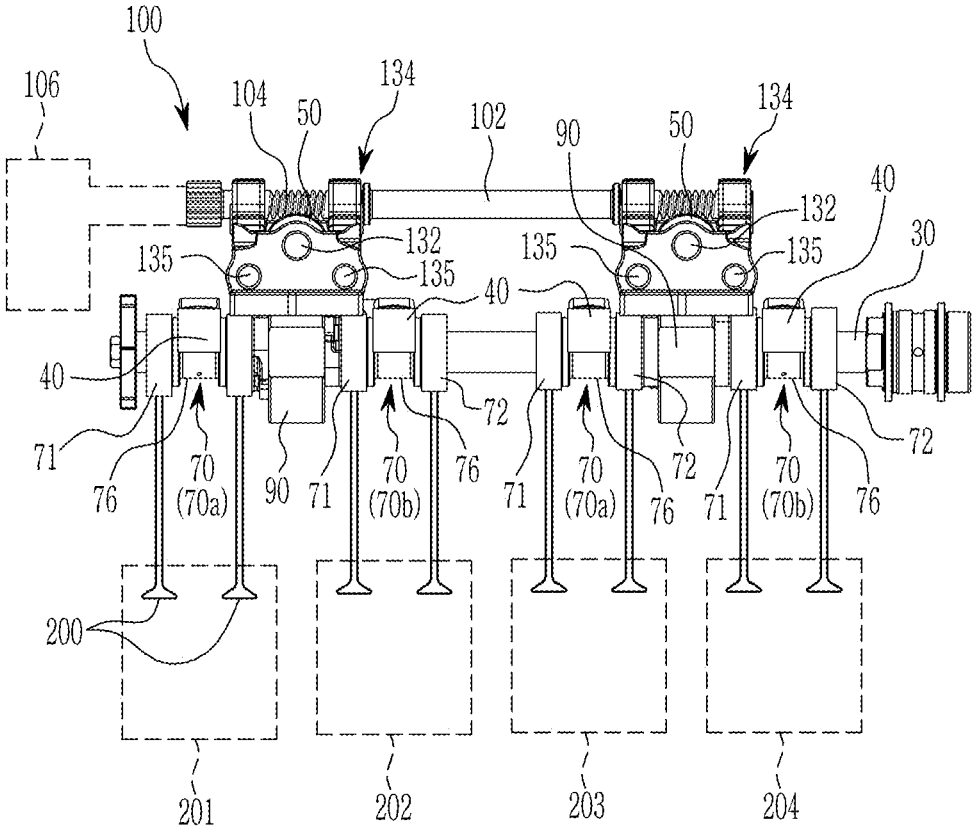
FIG. 2 is a side view of a continuously variable valve duration apparatus according to an embodiment of the present invention.

FIG. 1 is a perspective view of an engine provided with a continuously variable valve duration apparatus according to an embodiment of the present invention and FIG. 2 is a side view of a continuously variable valve duration apparatus according to an embodiment of the present invention.

Figure 3:
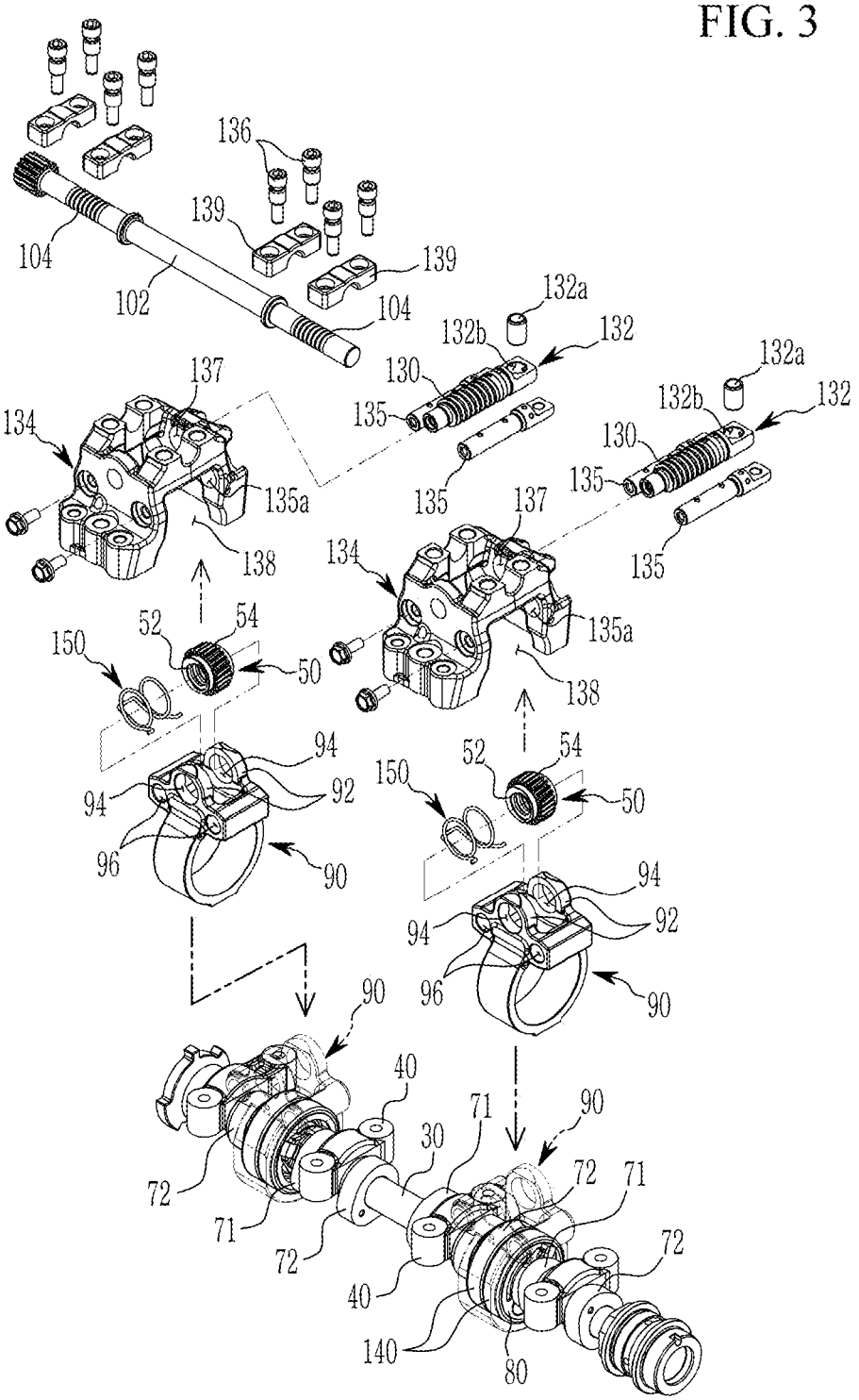
FIG. 3 is an exploded perspective view of a continuously variable valve duration apparatus according to an embodiment of the present invention.
Figure 4:
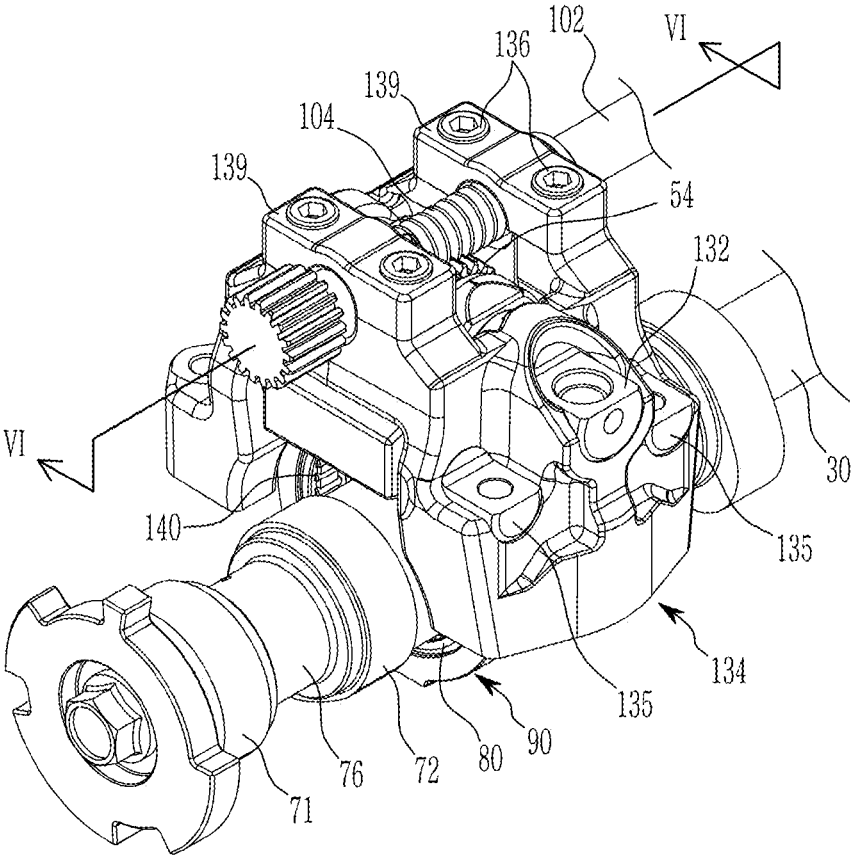
FIG. 4 is a partial perspective view of a continuously variable valve duration apparatus according to an embodiment of the present invention.

FIG. 3 is an exploded perspective view of a continuously variable valve duration apparatus according to an embodiment of the present invention and FIG. 4 is a partial perspective view of a continuously variable valve duration apparatus according to an embodiment of the present invention.

Figure 5:
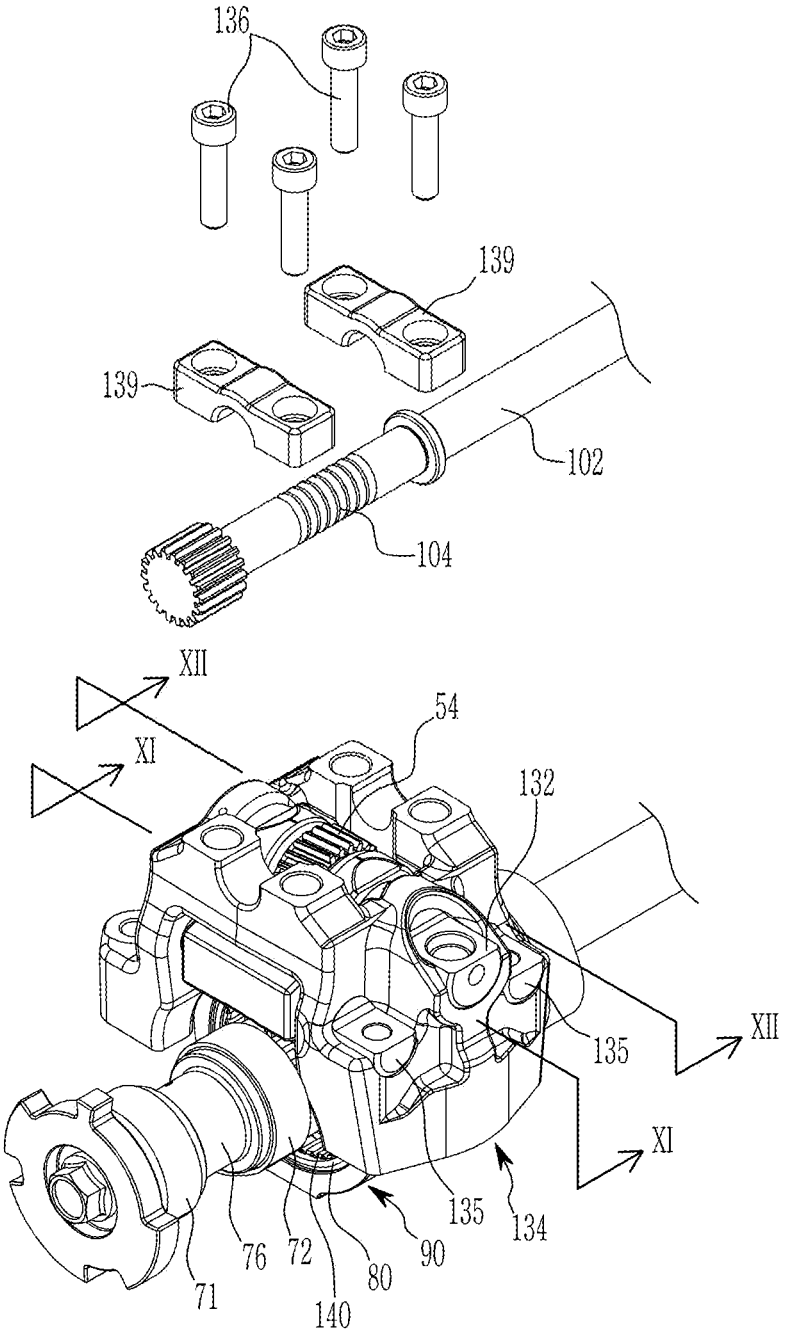
FIG. 5 is a partial exploded perspective view of a continuously variable valve duration apparatus according to an embodiment of the present invention.
Figure 6:
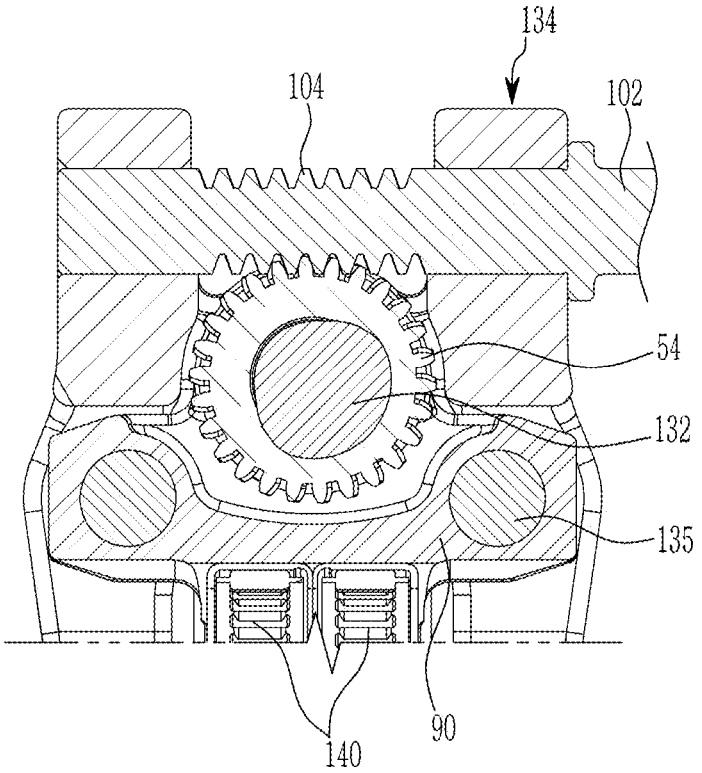
FIG. 6 is a cross-sectional view along line VI-VI of FIG. 4.

FIG. 5 is a partial exploded perspective view of a continuously variable valve duration apparatus according to an embodiment of the present invention and FIG. 6 is a cross-sectional view along line VI-VI of FIG. 4.

Referring to FIG. 1 to FIG. 6, in embodiments, an engine 1 according to an embodiment of the present invention includes a continuously variable valve duration apparatus.

In the drawings, 4 cylinders 211, 212, 213 and 214 are formed to the engine, but it is not limited thereto.

A continuously variable valve duration apparatus according to an embodiment of the present invention may include a camshaft 30, a cam unit 70 on which a cam 71 is formed, and the camshaft 30 inserted into the cam 71, a guide shaft 132 on which a guide screw thread 130 is formed and disposed perpendicular to the camshaft 30, a guide bracket 134 on which the guide shaft 132 is mounted, an inner wheel 80 configured to transmit rotation of the camshaft 30 to the cam unit 70, a wheel housing 90 into which the inner wheel 80 is rotatably inserted and movable perpendicular to the camshaft 30, and the wheel housing 90 disposed within the guide bracket 134, a worm wheel 50 to which an inner screw thread 52 configured to engage with the guide screw thread 130 is formed therewithin, and to which an outer screw thread 54 is formed thereon, and the worm wheel 50 disposed within the wheel housing 90, a control shaft 102 on which a control worm 104 configured to engage with the outer screw thread 54 is formed, and an wheel elastic portion 150 (referring to FIG. 9) providing elastic force to the worm wheel 50 to bring the worm wheel 50 into close contact with the guide shaft 132 and the control shaft 102.

The camshaft 30 may be an intake camshaft or an exhaust camshaft.

An insertion hole 137 into which the guide shaft 132 is inserted and a moving space 138 within which the wheel housing 90 is movable may be formed to the guide bracket 134.

The continuously variable valve duration apparatus may further include two guide walls 92 protruded from the wheel housing 90, and a moving hole 94 formed in each of the two guide walls 92 and the guide shaft 132 configured to insert into the moving holes 94.

The worm wheel 50 may be disposed between the guide walls 92 and configured to selectively push one of the two guide walls 92 to move the wheel housing 90.

The continuously variable valve duration apparatus further includes a sliding shaft 135 fixed to the guide bracket 134 through a sliding shaft hole 135*c* configured for guiding movement of the wheel housing 90 and a sliding hole 96 into which the sliding shaft 135 is inserted is formed to the wheel housing 90.

The continuously variable valve duration apparatus further includes a worm shaft cap 139 fixed to the guide bracket 134 configured for supporting the control shaft 102. The worm shaft cap 139 may be fixed to the guide bracket 134 through bolts 136.

Connecting scheme of the guide bracket 134, the wheel housing 90 and the worm wheel 50 may simply and minimize layout of the continuously variable valve duration apparatus. A connecting hole 132*b* is formed in the guide shaft 132 so that the guide shaft 132 can be coupled to the guide bracket 134 through a connecting pin 132*a*.

Figure 7:
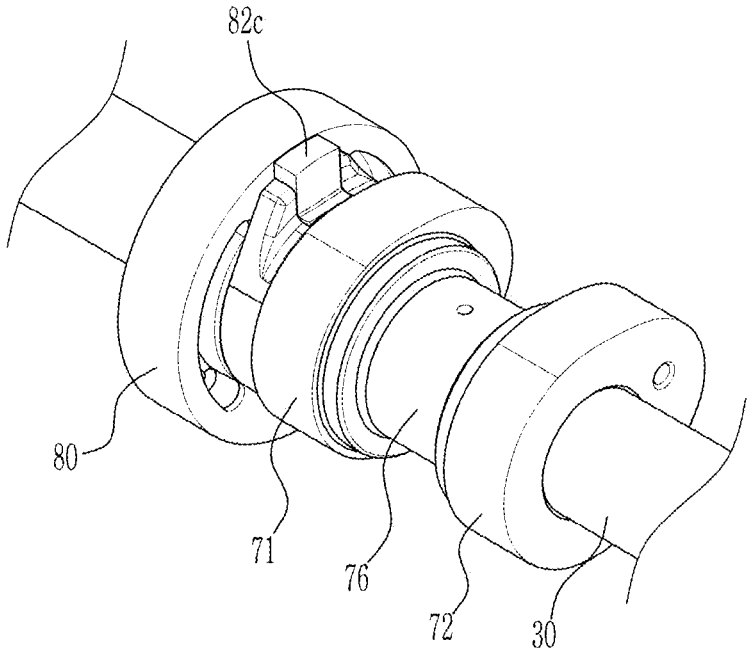
FIG. 7 is a perspective view showing an inner wheel and a cam unit applicable to an embodiment of the present invention.
Figure 8:
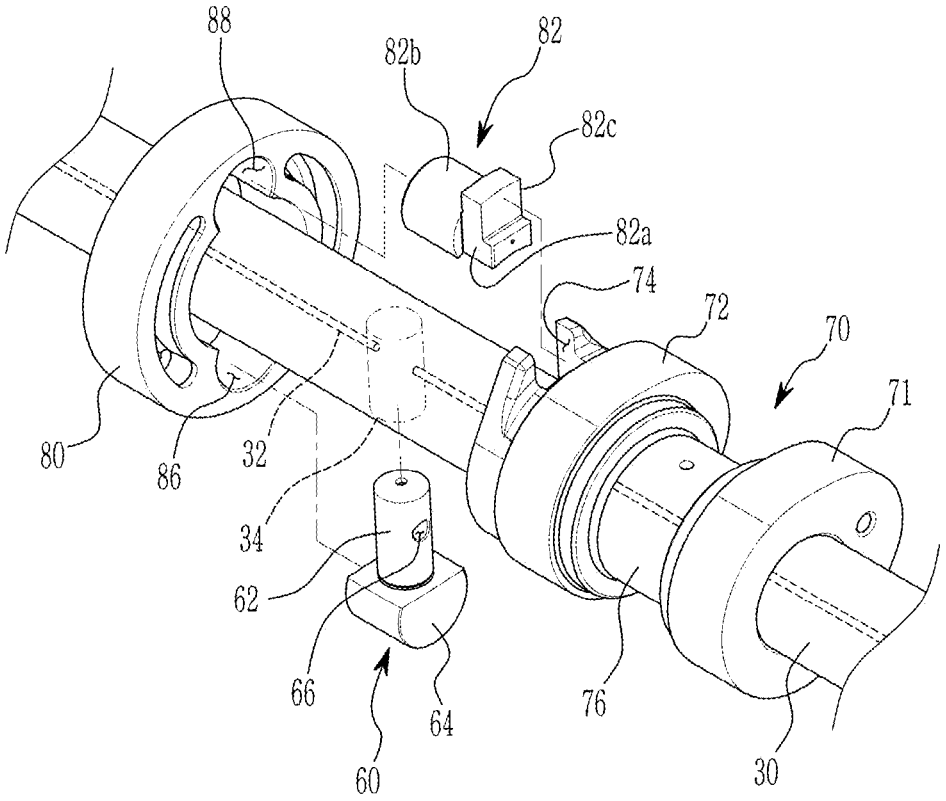
FIG. 8 is an exploded perspective view showing an inner wheel and a cam unit applicable to an embodiment of the present invention.

FIG. 7 is a perspective view showing an inner wheel and a cam unit applicable to an embodiment of the present invention and FIG. 8 is an exploded perspective view showing an inner wheel and a cam unit applicable to an embodiment of the present invention.

Referring to FIG. 1 to FIG. 8, a first sliding hole 86 and a second sliding hole 88 are formed the inner wheel 80 respectively and a cam slot 74 is formed to the cam unit 70.

The continuously variable valve duration apparatus further includes a roller wheel 60 connected to the camshaft 30 and rotatably inserted into the first sliding hole 86 and a roller cam 82 slidably inserted into the cam slot 74 and rotatably inserted into the second sliding hole 88.

The roller cam 82 includes a roller cam body 82*a* slidably inserted into the cam slot 74 and a cam head 82*b* rotatably inserted into the second sliding hole 88.

A protrusion 82*c* is formed at the roller cam 82 for preventing the roller cam 82 from being separated from the inner wheel 80 along the longitudinal direction of the camshaft 30.

The roller wheel 60 includes a wheel body 62 slidably connected to the camshaft 30 and a wheel head 64 rotatably inserted into the first sliding hole 86 and the wheel body 62 and the wheel head 64 may be integrally formed.

A camshaft hole 34 is formed to the camshaft 30, the wheel body 62 of the roller wheel 60 is movably inserted into the camshaft hole 34 and the wheel head 64 is rotatably inserted into the first sliding hole 86.

A camshaft oil hole 32 is formed within the camshaft 30 along a longitudinal direction thereof, a body oil hole 66 communicated with the camshaft oil hole 32 is formed to the wheel body 62 of the roller wheel 60 and an oil groove 68 (referring to FIG. 16) communicated with the body oil hole 66 is formed to the wheel head 64 of the roller wheel 60.

Lubricant supplied to the camshaft oil hole 32 may be supplied to the inner wheel 80 through the body oil hole 66, the communicate hole 69 and the oil groove 68.

Figure 9:
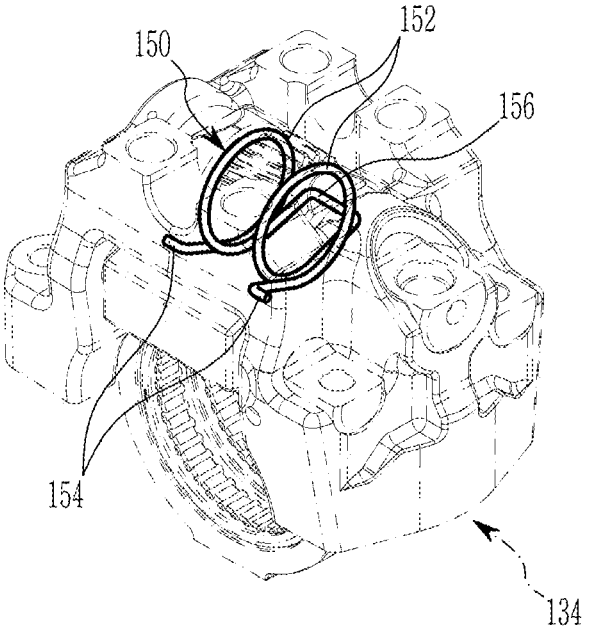
FIG. 9 is a perspective view showing mounting a wheel elastic portion according to an embodiment of the present invention.
Figure 10:
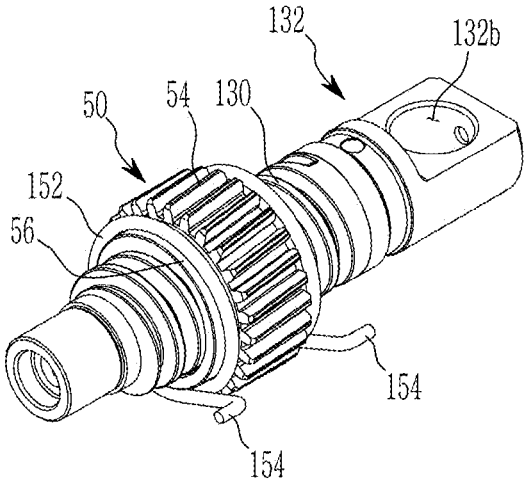
FIG. 10 is a perspective view showing a wheel elastic portion and a worm wheel applicable to an embodiment of the present invention.

FIG. 9 is a perspective view showing mounting a wheel elastic portion according to an embodiment of the present invention and FIG. 10 is a perspective view showing a wheel elastic portion and a worm wheel applicable to an embodiment of the present invention.

Figure 11:
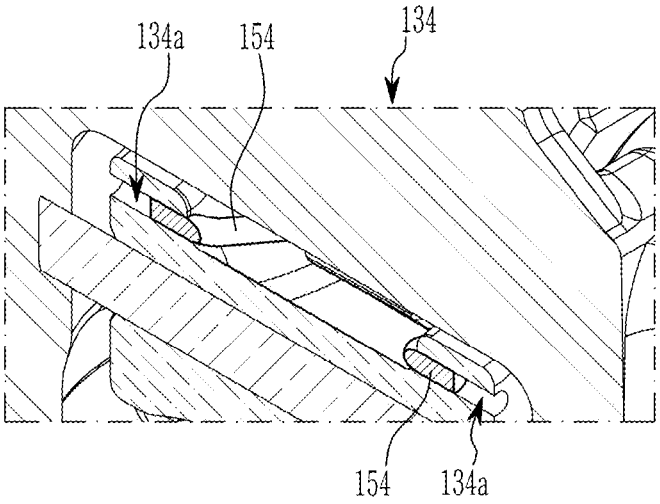
FIG. 11 is a cross-sectional view along line XI-XI of FIG. 5.
Figure 12:
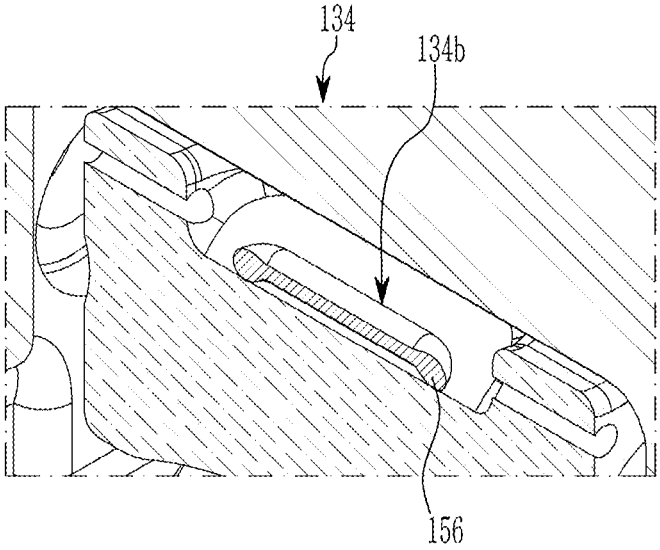
FIG. 12 is a cross-sectional view along line XII-XII of FIG. 5.

FIG. 11 is a cross-sectional view along line XI-XI of FIG. 5 and FIG. 12 is a cross-sectional view along line XII-XII of FIG. 5.

Referring to FIG. 9 to FIG. 12, the wheel elastic portion 150 may be a double torsion spring and a spring seating portion 56 to which the double torsion spring 150 is mounted is formed to the worm wheel 50.

The double torsion spring 150 may include a spring body 152 winding on the spring seating portion 56 and first and second support portions 154 and 456 for elastically supporting the spring body 152, and first and second spring insert portions 134*a* and 134*b* into which the first and second support portions 154 and 156 are inserted may be formed inside the guide bracket 134.

In embodiments, tolerances are required for the operation of each component of a continuously variable valve duration apparatus, but vibration and noise may occur during engine operation due to tolerances among the control worm 104, the worm wheel 50 and the guide screw thread 130.

Since the double torsion spring 150 may be configured to push the worm wheel 50 to the guide shaft 132 and the control shaft 102 to suppress vibration and noise generation during engine operation, with or without tolerances.

Figure 13:
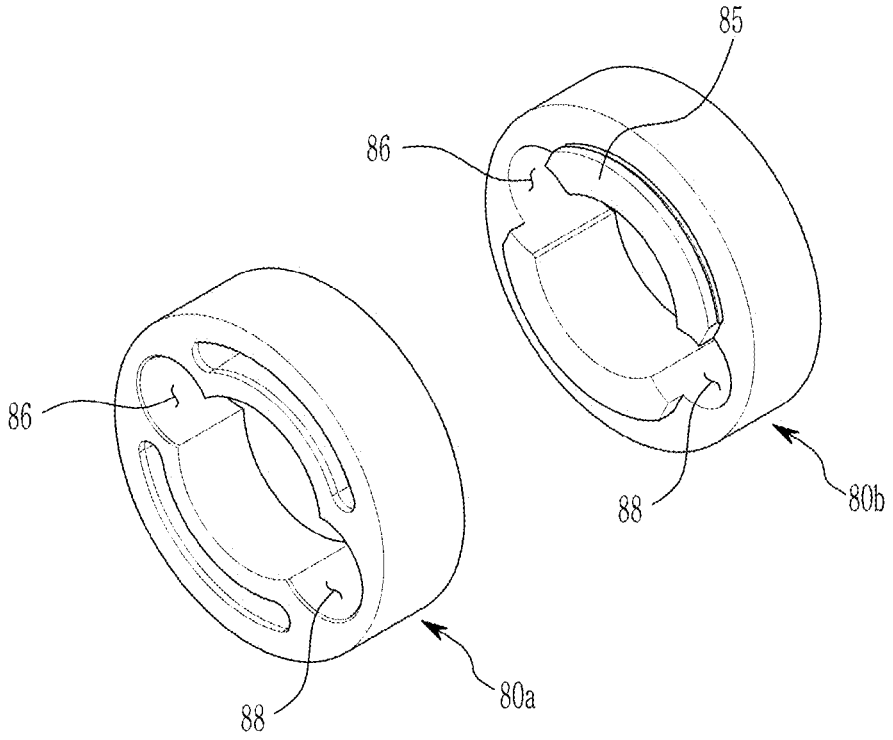
FIG. 13 and FIG. 14 are drawings showing an inner wheel of a continuously variable valve duration apparatus according to an embodiment of the present invention.
Figure 14:
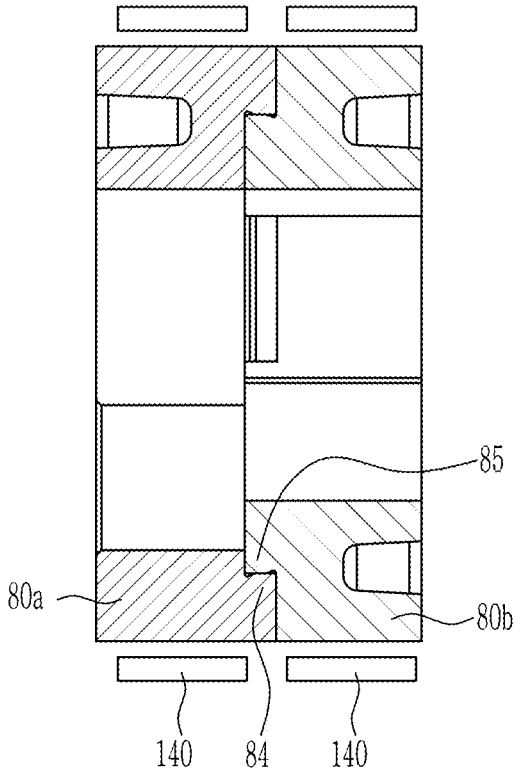

FIG. 13 and FIG. 14 are drawings showing an inner wheel of a continuously variable valve duration apparatus according to an embodiment of the present invention.

Referring to FIG. 2, FIG. 13 and FIG. 14, the cam unit 70 includes a first cam portion 70*a* and a second cam portion 70*b* which are disposed corresponding to a cylinder and an adjacent cylinder respectively, for example the first cylinder 201 and the adjacent second cylinder 202 and the inner wheel 80 includes a first inner wheel 80*a* and a second inner wheel 80*b* transmitting rotation of the camshaft 30 to the first cam portion 70*a* and the second cam portion 70*b* respectively.

The continuously variable valve duration apparatus further includes a bearing 140 disposed within the wheel housing 90 for supporting the first inner wheel 80*a* and the second inner wheel 80*b*.

The bearing 140 may be a needle bearing, the first and the second inner wheels 80*a* and 80*b* are disposed within one wheel housing 90 and the bearing 140 may rotatably support the first and the second inner wheels 80*a* and 80*b*.

Since the first and the second inner wheels 80*a* and 80*b* may be disposed within one wheel housing 90, element numbers may be reduced, so that productivity and manufacturing economy may be enhanced.

The first inner wheel 80*a* and the second inner wheel 80*b* within the wheel housing 90 may be connected rotatable to each other. For example, a first inner wheel connecting portion 84 and a second inner wheel connecting portion 85 are formed to the first inner wheel 80*a* and the second inner wheel 80*b* respectively, and the first inner wheel connecting portion 84 and the second inner wheel connecting portion 85 are connected to each other.

In the drawing, the first inner wheel connecting portion 84 and the second inner wheel connecting portion 85 are formed as convex and concave, it is not limited thereto. The first inner wheel 80*a* and the second inner wheel 80*b* are connected rotatable to each other with variable connecting structures.

In the case that the first inner wheel 80*a* and the second inner wheel 80*b* are connected, looseness or vibration due to manufacturing tolerances of the bearing, the inner wheel, the lifter and so on may be reduced.

Two cams 71 and 72 may be formed on the first and the second cam portions 70*a* and 70*b* as a pair and a cam cap connecting portion 76 is formed between the paired cams 71 and 72 of each of the first and second cam portions 70*a* and 70*b*.

The cam 71 and 72 rotate and open the valve 200.

The continuously variable valve duration apparatus further includes a cam cap 40 on which a cam supporting portion configured to rotatably support the cam cap connecting portion 76 is formed on the cam cap 40.

Figure 15A:
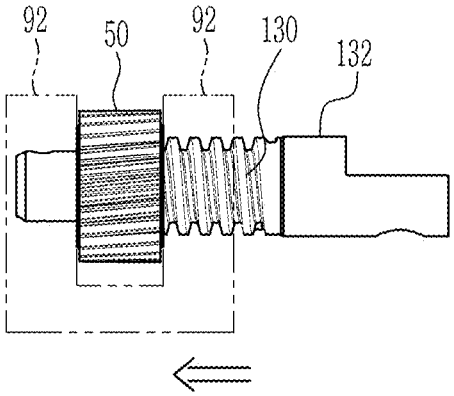
FIG. 15A and FIG. 15B are drawings showing an operation of worm wheel and a wheel housing according to an embodiment of the present invention.
Figure 15B:
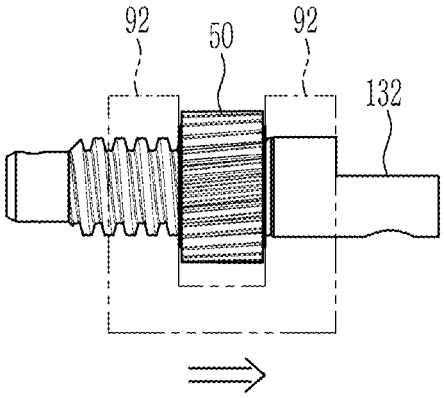
Figure 16:
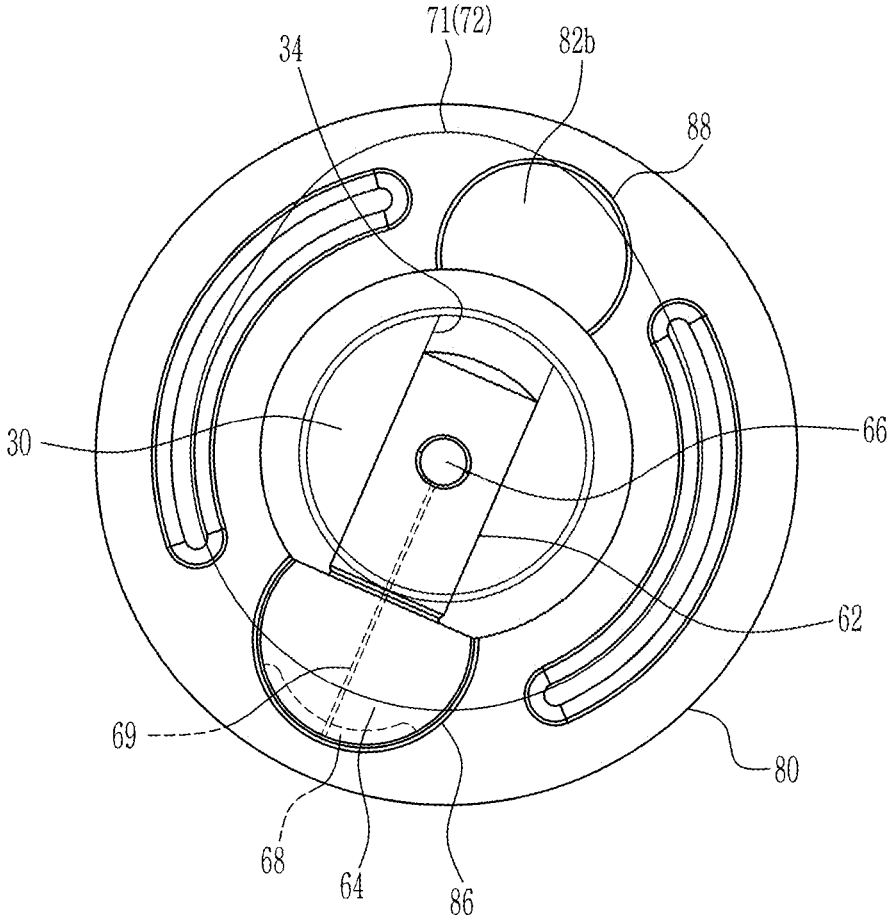
FIG. 16 to FIG. 18 are drawings showing operations of an inner wheel of a continuously variable valve duration apparatus according to an embodiment of the present invention.
Figure 17:
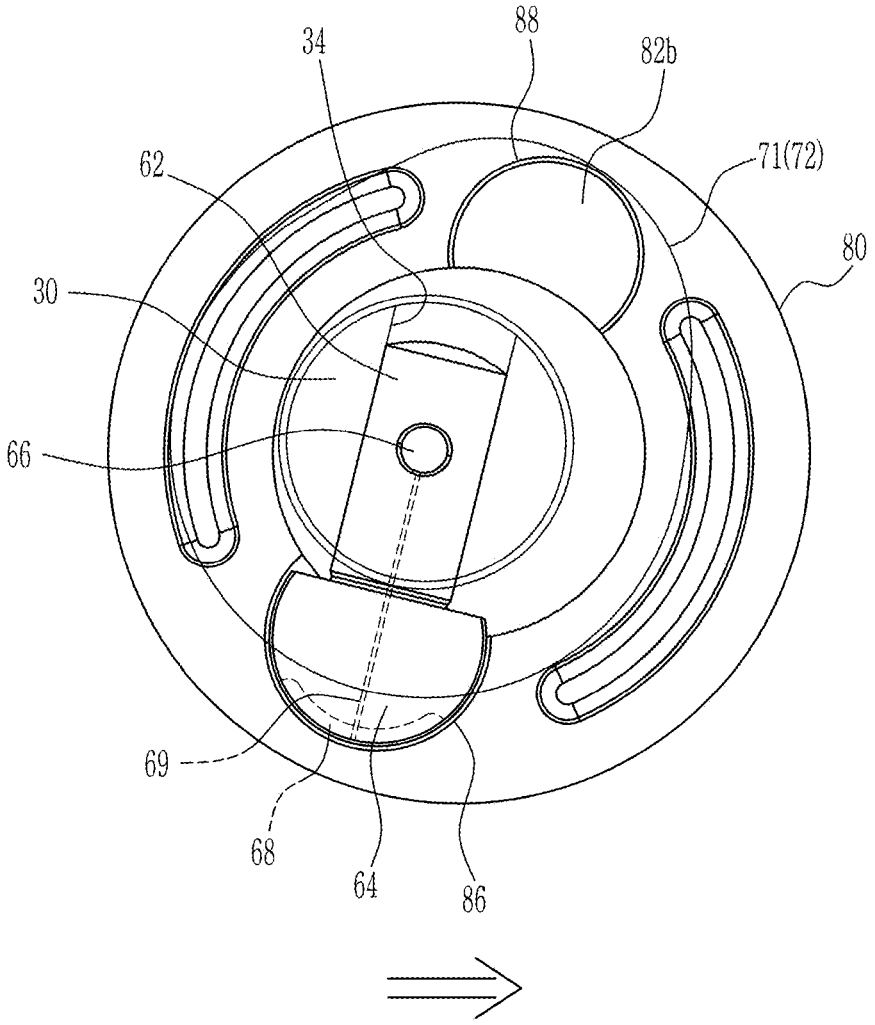
Figure 18:
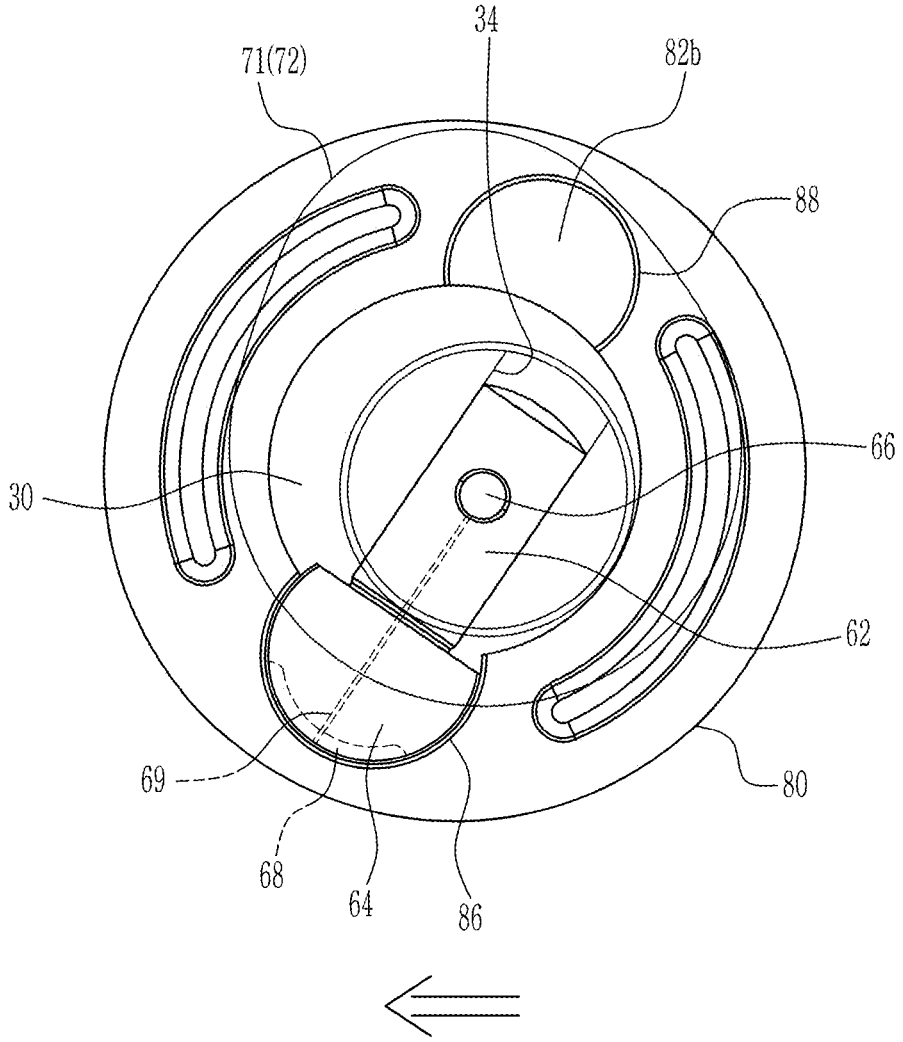

FIG. 15A and FIG. 15B are drawings showing an operation of worm wheel and a wheel housing according to an embodiment of the present invention and FIG. 16 to FIG. 18 are drawings showing operations of an inner wheel of a continuously variable valve duration apparatus according to an embodiment of the present invention.

As shown in FIG. 16, when rotation centers of the camshaft 30 and the cam unit 70 are coincident, the cams 71 and 72 rotate with the same phase angle of the camshaft 30.

In embodiments, based on engine operation states, an ECU (engine control unit or electric control unit) transmits control signals to the control portion 100, and then the control motor 106 rotates the control shaft 102.

Then, the control worm 104 engaged with the outer screw thread 54 rotates the worm wheel 50. And since the inner screw thread 52 formed to the worm wheel 50 is engaged with the guide screw thread 130 and thus the worm wheel 50 moves along the guide screw thread 130.

As shown in FIG. 15A, FIG. 15B, FIG. 17 and FIG. 18, the worm wheel 50 moves along the guide shaft 132 depending on the rotation of the control shaft 102 and the worm wheel 50 selectively pushes one of the two guide walls 92, and thus a relative position of the wheel housing 90 with respect to the camshaft 30 is changed.

When the relative position of the wheel housing 90 with respect to the camshaft 30 is changed, the relative rotation speed of the cams 71 and 72 with respect to the rotation speed of the camshaft 30 is changed.

While the slider pin 60 is rotated together with the camshaft 30, the pin body 62 is slidable within the camshaft hole 34, the pin head 64 is rotatable within the first sliding hole 86, and the roller cam 82 is rotatably within the second sliding hole 88 and slidable within the cam slot 74. Thus, the relative rotation speed of the cams 71 and 72 with respect to the rotation speed of the camshaft 30 is changed.

Figure 19A:
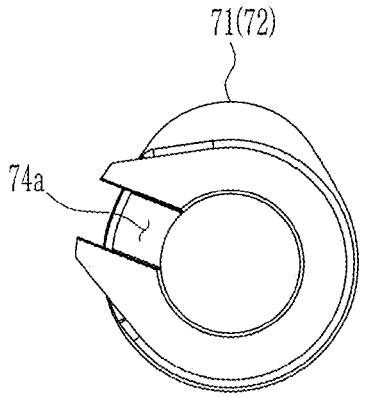
FIG. 19A and FIG. 19B are drawings showing a cam slot of a continuously variable valve duration apparatus according to an embodiment of the present invention.
Figure 19B:
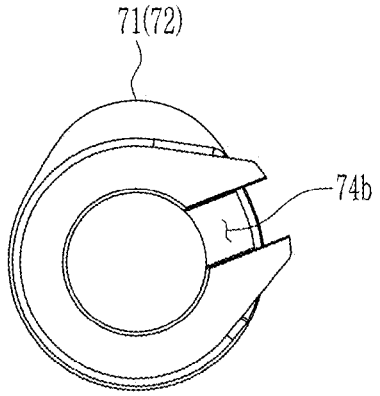
Figure 20A:
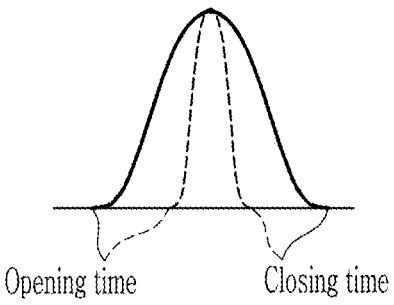
FIG. 20A, FIG. 20B and FIG. 20C are graphs showing valve profile of a continuously variable valve duration apparatus according to an embodiment of the present invention.
Figure 20B:
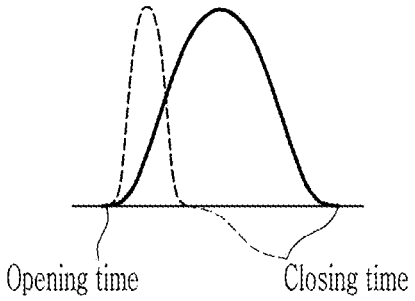
Figure 20C:
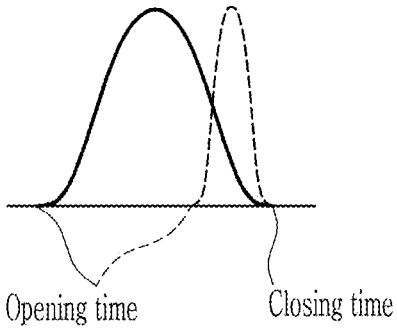

FIG. 19A and FIG. 19B are drawings showing a cam slot of a continuously variable valve duration apparatus according to an embodiment of the present invention and FIG. 20A, FIG. 20B and FIG. 20C are graphs showing valve profile of a continuously variable valve duration apparatus according to an embodiment of the present invention.

As shown in FIG. 19A and FIG. 19B, the cam slot 74 may be formed more retarded than a position of the cam 71 or 72 (referring to 74*a* of FIG. 19A) or the cam slot 74 may be formed more advanced than a position of the cam 71 or 72 (referring to 74*b* of FIG. 19B), or the cam slot 74 may be formed with the same phase of the cam 71 or 72. With the above scheme, various valve profiles may be achieved.

Although maximum lift of the valve 200 is constant, however rotation speed of the cam 71 and 72 with respect to the rotation speed of the camshaft 30 is changed depending on relative positions of the slider housing 90 so that closing and opening time of the valve 200 is changed. In an implementation, duration of the valve 200 is changed.

In embodiments, depending on the relative position of the cam slot 74, mounting angle of the valve 200 and so on, opening and closing time of the valve may be simultaneously changed as shown in FIG. 20A.

While opening time of the valve 200 is constant, closing time of the valve 200 may be retarded or advanced as shown FIG. 20B.

While closing time of the valve 200 is constant, opening time of the valve 200 may be retarded or advanced as shown FIG. 20C.

As described above, a continuously variable valve duration apparatus according to an embodiment of the present invention may achieve various valve duration with a simple construction. The continuously variable valve duration apparatus according to an embodiment of the present invention may be reduced in size and thus the entire height of a valve train may be reduced.

Since the continuously variable valve duration apparatus may be applied to an existing engine without excessive modification, thus productivity may be enhance and production cost may be reduced.

The continuously variable valve duration apparatus according to an embodiment of the present invention can reduce noise and vibration by applying a wheel elastic portion even if there is a production error in the parts.

While embodiments of this invention have been described, it is to be understood that the invention is not limited to the disclosed embodiments. On the contrary, it is intended to cover various modifications and equivalent arrangements included within the spirit and scope of the appended claims.

What is claimed is:

1. A continuously variable valve duration apparatus comprising:

a camshaft;

a cam unit comprising a cam, and the camshaft being inserted into the cam;

a guide shaft comprising a guide screw thread and disposed perpendicular to the camshaft;

a guide bracket on which the guide shaft is mounted;

an inner wheel configured to transmit rotation of the camshaft to the cam unit;

a wheel housing into which the inner wheel is rotatably inserted and configured to move perpendicular to the camshaft, and the wheel housing being disposed within the guide bracket;

a worm wheel comprising an inner screw thread and an outer screw thread, the inner screw thread being configured to engage with the guide screw thread, and the worm wheel being disposed within the wheel housing;

a control shaft comprising a control worm configured to engage with the outer screw thread; and a wheel elastic portion configured to apply elastic force to the worm wheel so as to bring the worm wheel into contact with the guide shaft and the control shaft.

2. The continuously variable valve duration apparatus of claim 1, wherein the wheel elastic portion comprises a double torsion spring.

3. The continuously variable valve duration apparatus of claim 2, wherein the worm wheel comprises a spring seating portion to which the double torsion spring is mounted.

4. The continuously variable valve duration apparatus of claim 3, wherein the double torsion spring comprises:

a spring body winding on the spring seating portion; and first and second support portions configured to elastically support the spring body, and wherein the guide bracket comprises first and second spring insert portions into which the first and second support portions are inserted.

5. The continuously variable valve duration apparatus of claim 1, wherein the guide bracket comprises an insertion hole into which the guide shaft is inserted and a moving space within which the wheel housing is configured to move.

6. The continuously variable valve duration apparatus of claim 1, further comprising:

two guide walls protruding from the wheel housing; and each of the two guide walls comprising a moving hole, and the guide shaft is configured to be inserted into the moving holes.

7. The continuously variable valve duration apparatus of claim 6, wherein the worm wheel is disposed between the two guide walls and configured to selectively push one of the two guide walls so as to move the wheel housing.

8. The continuously variable valve duration apparatus of claim 1, further comprising a sliding shaft fixed to the guide bracket and configured to guide movement of the wheel housing; and wherein the wheel housing comprises a sliding hole, and the sliding shaft is configured to be inserted in the sliding hole.

9. The continuously variable valve duration apparatus of claim 1, further comprising a worm shaft cap fixed to the guide bracket and configured to support the control shaft.

10. The continuously variable valve duration apparatus of claim 1, further comprising:

a first sliding hole and a second sliding hole formed in the inner wheel;

a cam slot formed in the cam unit;

a roller wheel connected to the camshaft and rotatably inserted into the first sliding hole; and a roller cam slidably inserted into the cam slot and rotatably inserted into the second sliding hole.

11. The continuously variable valve duration apparatus of claim 10, wherein the roller cam comprises:

a roller cam body slidably inserted into the cam slot;

a cam head rotatably inserted into the second sliding hole; and a protrusion configured to inhibit the roller cam from being removed.

12. The continuously variable valve duration apparatus of claim 10, wherein the roller wheel comprises:

a wheel body slidably connected to the camshaft; and a wheel head rotatably inserted into the first sliding hole.

13. The continuously variable valve duration apparatus of claim 12, further comprising:

a camshaft oil hole extending along a longitudinal direction of the camshaft;

the wheel body of the roller wheel comprising a body oil hole configured to communicate with the camshaft oil hole; and the wheel head of the roller wheel comprising an oil groove configured to communicate with the body oil hole.

14. The continuously variable valve duration apparatus of claim 1, wherein:

the cam unit includes a first cam portion and a second cam portion corresponding to a first cylinder and an adjacent second cylinder, respectively; and the inner wheel includes a first inner wheel and a second inner wheel configured to transmit the rotation of the camshaft to the first cam portion and the second cam portion, respectively.

15. The continuously variable valve duration apparatus of claim 14, wherein the first inner wheel and the second inner wheel are configured to rotate with respect to each other.

16. The continuously variable valve duration apparatus of claim 14, further comprising a bearing disposed within the wheel housing and configured to support the first inner wheel and the second inner wheel.

17. The continuously variable valve duration apparatus of claim 14, wherein:

the cam includes two cams formed on the first cam portion and the second cam portion, respectively;

a cam connecting portion is formed between the two cams; and a cam cap is formed on the cam connecting portion.

18. An engine comprising the continuously variable valve duration apparatus of claim 1.

* * * * *